US005425354A

United States Patent [19]

Park

[11] Patent Number: 5,425,354

[45] Date of Patent: Jun. 20, 1995

[54] PORTABLE GAS RANGE WITH FOLDING TRIPOD

[75] Inventor: Kyung-Woo Park, Kyungki-do, Rep. of Korea

[73] Assignee: Tong Yang Magic Corp., Seoul, Rep. of Korea

[21] Appl. No.: 245,413

[22] Filed: May 17, 1994

[30] Foreign Application Priority Data

Dec. 23, 1993 [KR] Rep. of Korea ..... 1993-29192

[51] Int. Cl.[6] ..... F24C 5/00

[52] U.S. Cl. ..... 126/50; 126/38; 126/30

[58] Field of Search ..... 126/50, 38, 30, 9 B, 126/52, 275 R, 273 R, 42

[56] References Cited

U.S. PATENT DOCUMENTS

| | | | |
|---|---|---|---|
| 2,217,750 | 10/1940 | Höckenström | 126/38 |
| 2,728,335 | 12/1955 | Garrett et al. | 126/38 |
| 2,928,386 | 3/1960 | Keyt et al. | 126/38 |
| 3,809,054 | 5/1974 | Bowman et al. | 126/38 |
| 4,122,764 | 10/1978 | D'Ambra | 126/38 X |
| 4,192,284 | 3/1980 | Vache | 126/38 |
| 4,512,328 | 4/1985 | Arad | 126/52 X |
| 4,653,462 | 3/1987 | DeFoe | 126/24 |
| 5,211,157 | 5/1993 | Schwartz et al. | 126/52 X |

FOREIGN PATENT DOCUMENTS 422564 4/1991 European Pat. Off. ..... 126/40

*Primary Examiner*—Larry Jones

*Attorney, Agent, or Firm*—Morgan & Finnegan

[57] ABSTRACT

A portable gas range with a folding tripod. The portable gas range includes a bracket mounted on the gas range housing and rotatably supporting the inner ends of the pair of rotatable tripod members hinged to opposed sides of the bracket by hinge pins. This bracket has a pair of arcuate guide slits centering about the hinge pins. The guide pins are fixedly mounted on the inner ends of the rotatable tripod members and received in the arcuate guide slits. The moving plate is placed on the bracket such that it is linearly moved on the bracket. This moving plate mounts the rear tripod member on its rear end and is provided with a pair of longitudinal openings for receiving the guide pins penetrating the arcuate guide slits. The tripod folding lever has a push handle at an end thereof projecting out of the range housing. The other end of the tripod folding lever is connected to the moving plate, thus to linearly move the moving plate when the push handle is pushed. The tripod folding lever includes a stopper for restricting a downward levering of the gas supply lever when the tripod folding lever is in its tripod folding position, thus to prevent gas supply for a burner of the gas range.

2 Claims, 4 Drawing Sheets

PORTABLE GAS RANGE WITH FOLDING TRIPOD

BACKGROUND OF THE INVENTION

1. Field of the Invention

The present invention relates in general boa portable gas range and, more particularly, to a portable gas range provided with a folding tripod achieving the compactness and facilitating carrying of the gas range.

2. Description of the Prior Art

Korean Utility Model Application No. 92-19080 applied by this applicant discloses a portable gas range provided with a folding tripod. In this gas range, a supporter receiving cover is provided at a side of a burner section such that it protrudes from the range housing. The supporter of this gas range is received in the above receiving cover and appears from and disappears in the receiving cover. This supporter is placed on the center of the burner section when its appears out of the supporter receiving cover. A stationary tripod member is fixed at the front of the supporter while a pair of moving tripod members are mounted on opposed sides of the supporter such that they are rotatable in the directions toward the stationary tripod member. At the back of the supporter, a tripod folding lever extends in order to penetrate the supporter receiving cover and is provided with a push handle at its free end. A guide groove is formed at a position under the tripod folding lever and guides the movement of the tripod folding lever.

However, the supporter of the gas range is operated on the burner section of the gas range and, as a result, it is very difficult to precisely locate the supporter on the center of the burner section when the supporter appears out of the supporter receiving cover. Hence, the supporter may cause nonuniform and bad combustion of the burner. In addition, since the tripod members necessarily come into frictional contact with the front end of the receiving cover whenever they disappear in the range housing, they are easily abraded and apt to be troubled. Another problem of the above gas range is resided in that its folding tripod requires additional manual operation for completely spreading out this tripod after levering for projecting the tripod out of the range housing. Furthermore, the above gas range may supply the gas of a gas container for its burner even when the folding tripod members are not projected out of the range housing and, as a result, the burner may be ignited even when the folding tripod members are not completely spread out. Hence, the above gas range has a problem in that it does not insure a desired safety in use.

SUMMARY OF THE INVENTION

It is, therefore, an object of the present invention to provide a portable gas range with a folding tripod in which the aforementioned problems of the conventional portable gas range can be overcome and which projects and completely spreads the folding tripod out of a range housing by pushing once a folding lever and retracts the folding tripod in the range housing so as to provide a good outer appearance of the gas range and improves the operational efficiency of the gas range.

It is another object of the present invention to provide a portable gas range with a folding tripod which does not allow botch engagement of a gas container with a gas supply cock and ignition of the burner when the folding tripod is not completely spread out of the range housing, thus to achieve a desired safety in use of the range.

In order to accomplish the above objects, a portable gas range with a folding tripod in accordance with an embodiment of the present invention comprises a bracket mounted on an inner bottom of a gas range housing and rotatably supporting inner ends of an opposed pair of rotatable tripod members hinged to opposed sides of the bracket by hinge pins, the bracket having an opposed pair of arcuate guide slits respectively centering about the hinge pins; a pair of guide pins fixedly mounted on the inner ends of the rotatable tripod members and received in the arcuate guide slits respectively such that they are moved in the guide slits; a moving plate placed on the bracket such that it is linearly moved forward and backward on the bracket, the moving place mounting a rear tripod member on its rear end and provided with an opposed pair of longitudinal openings for movably receiving the guide pins penetrating the arcuate guide slits; a tripod folding lever having a push handle at an end thereof projecting out of an outer upper surface of the range housing, the other end of the tripod folding lever being connected to the moving plate, thus to linearly move the moving plate when the push handle is pushed, the tripod folding lever having a stopper for restricting a downward levering of a gas container engaging lever when the tripod folding lever is in its tripod folding position, thus to prevent gas supply for a burner of the gas range.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
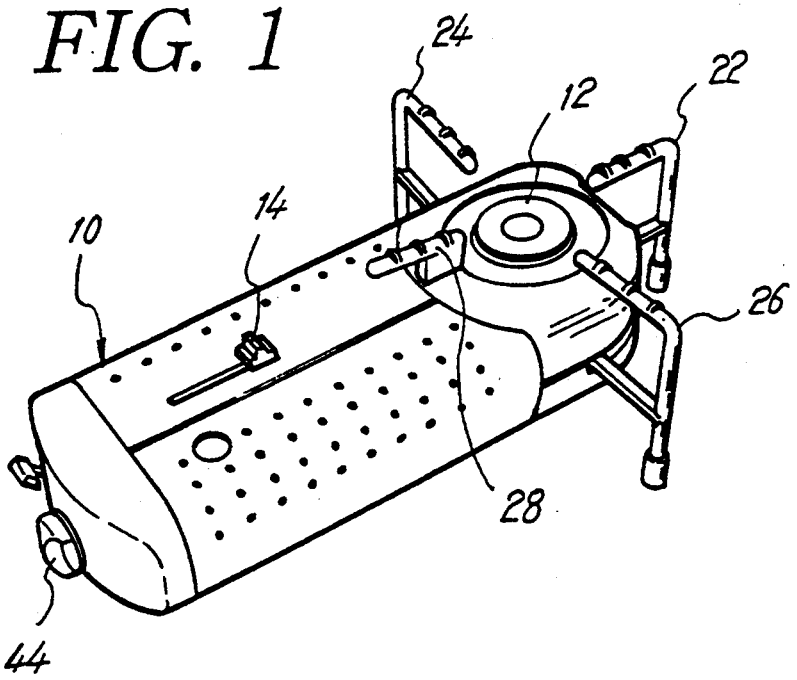
FIG. 1 is a perspective view of a portable gas range provided with a folding tripod in accordance with an embodiment of the present invention.
Figure 2:
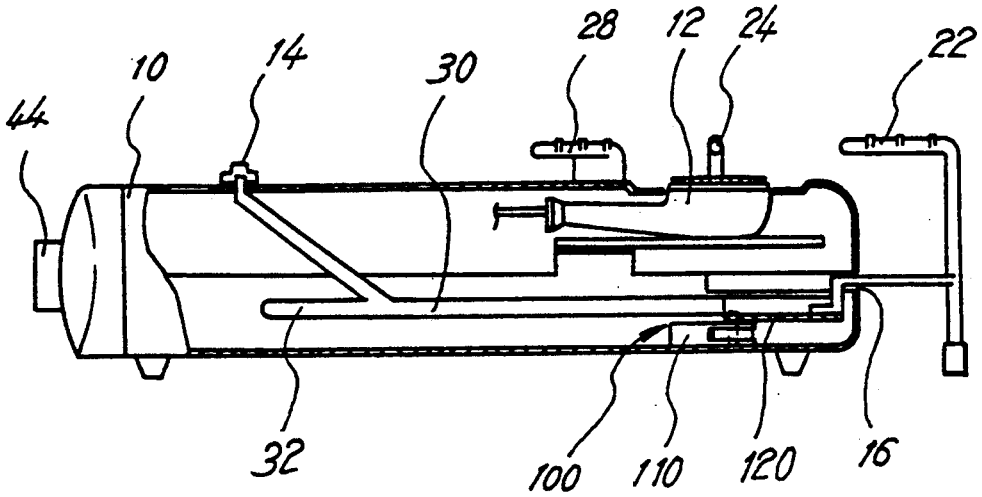
FIG. 2 is a longitudinal sectional view of the portable gas range of FIG. 1, showing its inner construction.

With reference to FIG. 1, there is shown in a perspective view a portable gas range provided with a folding tripod in accordance with an embodiment of the present invention. The portable gas range is encased by a range housing 10 of which the rear section is provided with a burner 12. The tripod of this gas range comprises a stationary tripod member 28 and three movable tripod members 22, 24 and 26. In this drawing, the three movable tripod members 22, 24 and 26 completely extend from the range housing 10. A tripod extending slit 16, through which the three movable tripod members 22, 24 and 26 appear and disappear, is formed on a rounded periphery of the burner section of the range housing 10. A push handle 14 is received in a longitudinal guide slit formed on the range housing 10 and handled at the outside. This push handle 14 is connected to a projecting free end of a tripod folding lever 30. The other end of the lever 30 is mounted on tripod folding means 100 which will be described in detail below. The three movable tripod members 22, 24 and 26 are connected to and cooperate with this tripod folding means 100 as shown in FIG. 2.

Figure 3:
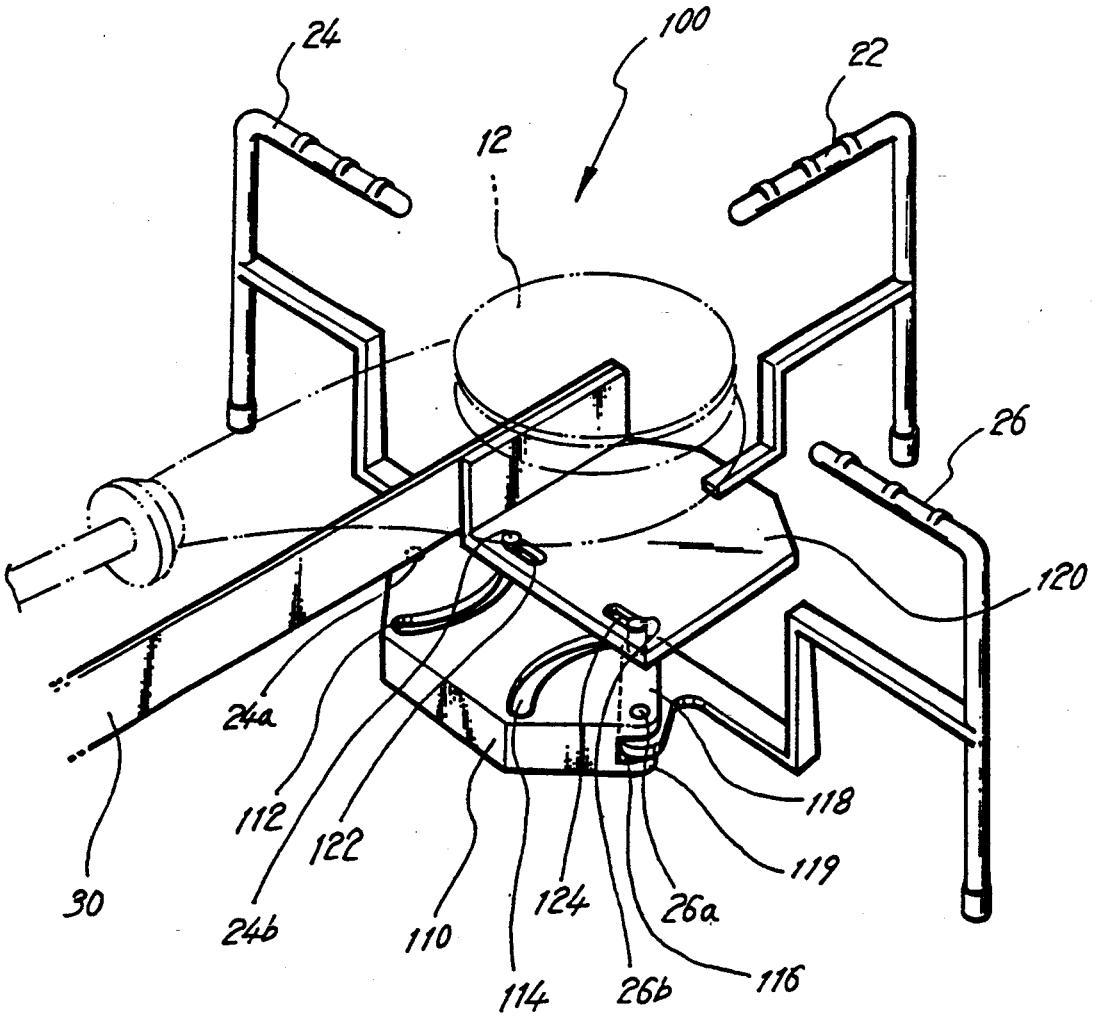
FIG. 3 is an enlarged perspective view of the folding tripod and tripod folding means of the gas range of FIG. 1.

Turning to FIG. 3 showing interrelation between the movable tripod members 22, 24 and 26 and the tripod folding means 100, the folding means 100 comprises a tripod bracket 110 fixedly mounted on an inner bottom surface of the range housing 10. This tripod bracket 110 is provided with a horizontal narrow recess 116. The opposed sides of the recess 116 rotatably receive the inner ends of a pair of rotatable tripod members, that is, the left tripod member 24 and the right tripod member 26. In order to rotatably retain the tripod members 24 and 26 in the sides of the recess 116 of the bracket 110, the inner ends of the rotatable tripod members 24 and 26 are hinged to the bracket 110 by their respective hinge pins 24*a* and 26*a*. The tripod bracket 110 is also provided with an opposed pair of arcuate guide slits 112 and 114. The rotatable tri pod members 24 and 26 have their respect extending parts at their inner ends. The extending parts of the members 24 and 26 are provided with their respective guide pins 24*b* and 26*b* which are received in and guided by the arcuate guide slits 112 and 114 of the bracket 110.

The tripod folding means further includes a moving plate 120 movably placed on the upper surface of the bracket 110 such that it is moved with respect to the bracket 110. This moving plate 120 is provided with an opposed pair of longitudinal openings 122 and 124 for movably receiving the guide pins 24*b* and 26*b* of the rotatable tripod members 24 and 26 respectively, which pins 24*b* and 26*b* are also received in the arcuate guide slits 112 and 114 of the bracket 110 as described above.

The moving plate 120 is fixedly connected to the end of the tripod folding lever 30, of which lever 30 the projecting end is provided with the push handle 14. Hence, the moving plate 120 is linearly moved on the bracket 110 in accordance with pushing motion of the push handle 14.

As described above, the three movable tripod members 22, 24 and 28 completely extend out of and nearly disappear in the range housing 10 through the tripod extending slit 16 of the housing 10.

Differently from the above rotatable tripod members 24 and 26, the rear tripod member 26 is fixedly mounted on the rear section of the moving plate 120 and linearly moved frontward or backward in accordance with a linear movement of the moving plate 120.

The horizontal narrow recess 116 of the bracket 110 movably receiving the inner ends of the rotatable tripod members 24 and 26 is defined between top and bottom plate sections 118 and 119 of the bracket 110. The top and bottom plate sections 118 and 119 are integrally connected to each other at their front edges. In this description, that the directional term "front" means a direction toward the push handle 14 while the term "back" means a direction toward the burner 12. The arcuate guide slits 112 and 114, receiving and guiding the guide pins 24*b* and 26*b* of the rotatable tripod members 24 and 26 respectively, are formed on opposed sides of the top plate section 118 such that their rotating centers are the hinge pins 24*a* and 26*a*. Hence, when bring the rotatable tripod members 24 and 26 into engagement with the folding means 100, the guide pins 24*b* and 26*b* of the members 24 and 26 extend upward from the recess 116 through both the arcuate guide slits 112 and 114 of the bracket 110 and the longitudinal openings 122 and 124 of the moving plate 120. Accordingly, when the moving plate 120 is linearly moved on the bracket 110, the guide pins 24*b* and 26*b* of the rotatable tripod members 24 and 26 are moved under the guide of the arcuate guide slits 112 and 114 and the openings 122 and 124.

Hence, when linearly moving the moving plate 120 on the bracket 110, the rear tripod member 22 is linear moved frontward or backward and, at the same time, the rotatable tripod members 24 and 26 are burned in opposed directions about their respective hinge pins 24*a* and 26*a* by angular displacements of their guide pins 24*b* and 26*b* in the arcuate guide slits 112 and 114 of the bracket 110.

Figure 4:
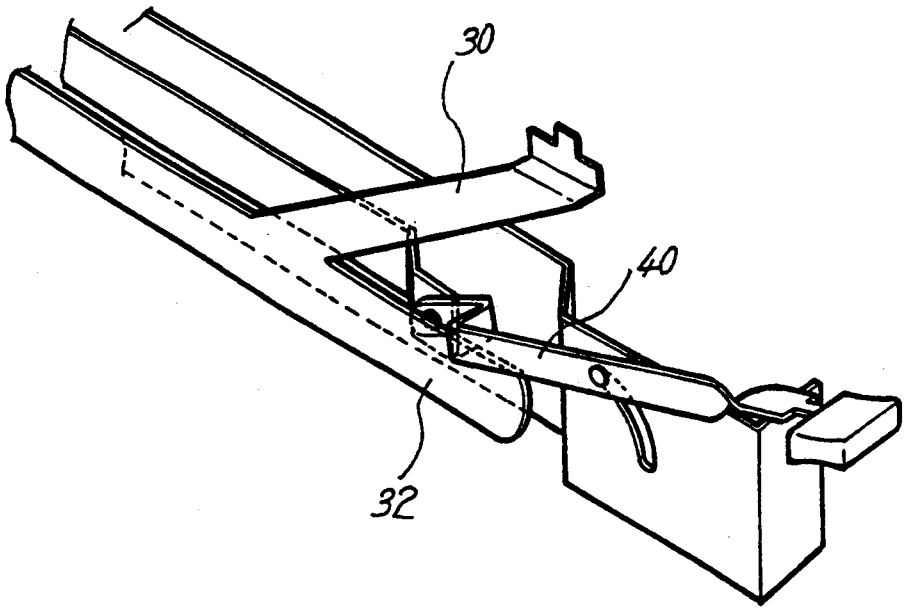
FIG. 4 is a perspective view showing means for restricting a gas supply lever of the gas range of FIG. 1.

Turning to FIG. 4, the folding lever 30 is provided with a stopper 32 horizontally forwardly extending from the front end of the lever 30. This stopper 32 is positioned under a bent portion of a gas supply lever 40 as shown at the solid line of FIG. 5 when the folding lever 30 is pushed frontwards in order to retract the movable tripod members 22, 24 and 26 in the range housing 10. At this position, the stopper 32 restricts the downward levering of the gas supply lever 40, thus to prevent gas supply for the burner 12. However, when completely pushing the folding lever 30 backwards as shown at the phantom line of FIG. 5 in order to completely project the members 22, 24 and 26 out of the range housing 10, the downward levering of the gas supply lever 40 is not disturbed by the stopper 32, so that the gas supply for the burner 12 is achieved.

In the drawings, the reference numeral 42 denotes a gas container, 44 denotes an ignition knob, 46 denotes a gas supply cock and 48 denotes a gas container charging chamber.

Figure 5:
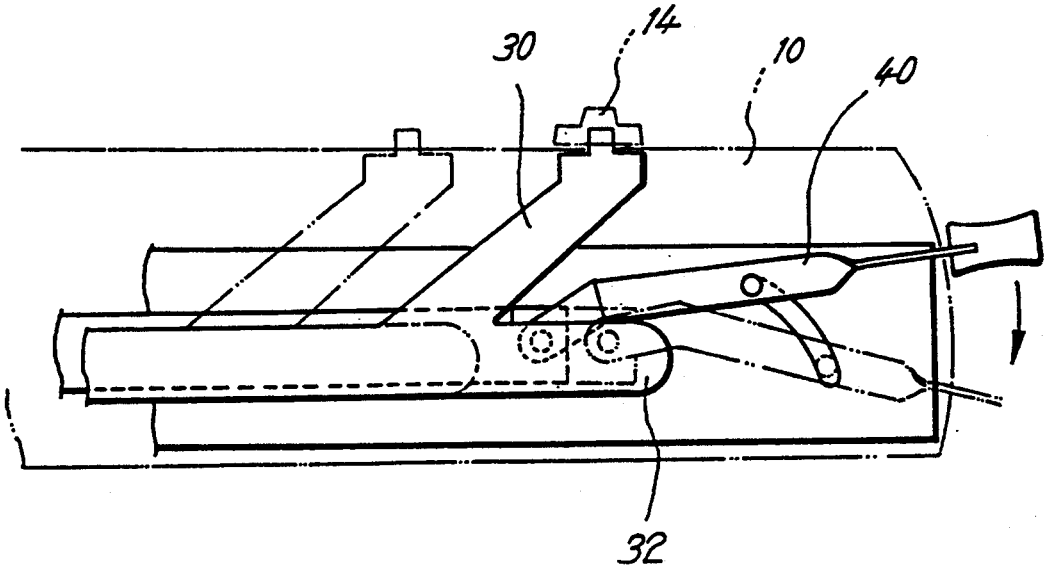
FIG. 5 is a side view showing an operation of the gas supply lever restricting means of FIG. 4.
Figure 6:
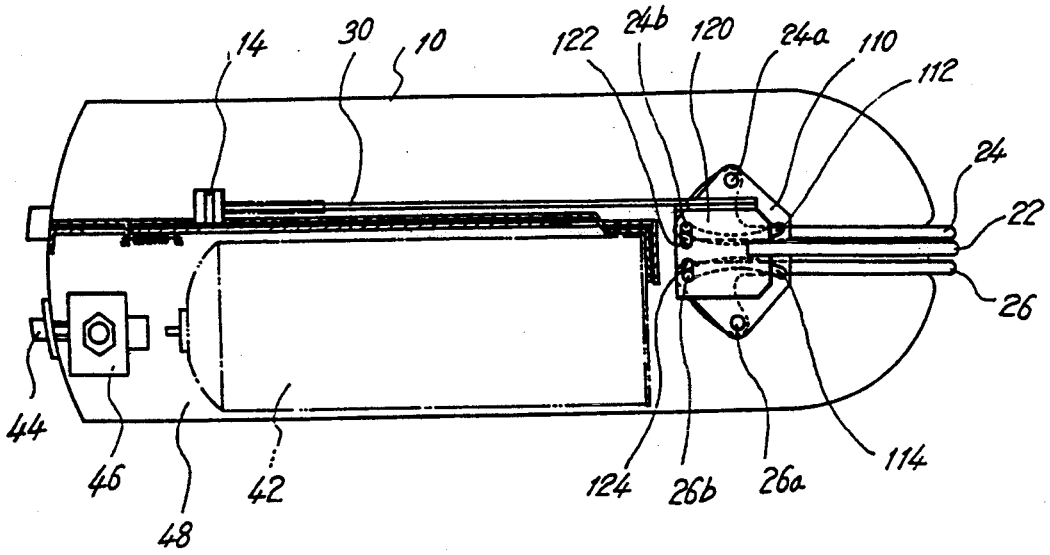
FIG. 6 is a plan view of the gas range of FIG. 1 in its tripod folding state.

In operation of the above portable gas range, when pushing the folding lever 30 frontwards in order to cause the movable tripod members 22, 24 and 26 to disappear in the range housing 10, the stopper 32 is positioned under the bent portion of the gas supply lever 40 as shown at the solid line of FIG. 5. At this position, the stopper 32 restricts the downward levering of the gas supply lever 40, thus to prevent the gas container 42 from engagement with the gas supply cock 46. Therefore, the ignition of the burner 12 can not be achieved even when the ignition knob 44 is mistakenly operated at this state. In this regard, the portable gas range of this invention reliably prevents the burner from being unconsciously ignited when the folding tripod members are not projected from the range housing 10 such as in the case of carrying along with one.

Figure 7:
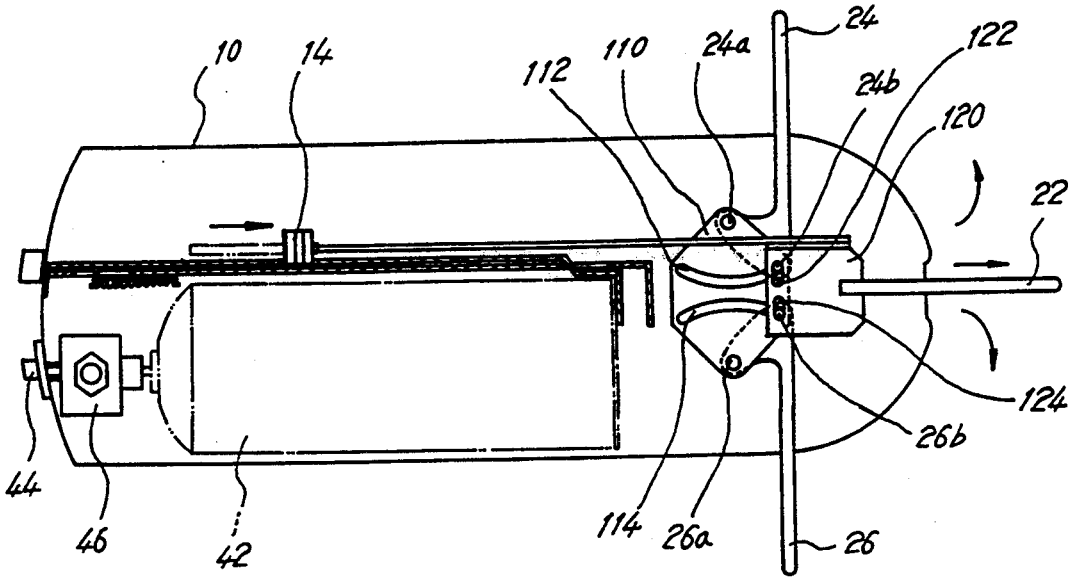
FIG. 7 is a plan view of the gas range of FIG. 1 in its tripod spreading state.

Hence, it should be required to completely project the movable tripod members 22, 24 and 26 out of the range housing 10 when the gas container 42 intend to be brought into engagement with the gas supply cock 46. In order to engage the gas container 42 with the gas supply cock 46, the push handle 14 of the folding lever 30 is pushed backwards under the condition that the gas container 42 is charged in the gas container charging chamber 48 of the range, thus to push the folding lever 30 backwards and to linearly move the moving plate 120 of the tripod folding means 100. Therefore, the rear tripod member 22 fixedly mounted on the rear section of the moving plate 120 is linearly moved backwards in order to extend out of the rear end of the range housing 10 as shown FIG. 7. At the same time, the guide pins **24*b* and 26*b* of the rotatable tripod members 24 and 26 respectively received in the longitudinal openings 122 and 124 of the moving plate 120 are moved backwards under the guide of the arcuate guide slits 112 and 114 of the bracket 110. Thus, the rotatable tripod members 24 and 26 are turned in opposed directions about their respective hinge pins 24*a* and 26*a* hinged to the bracket 110. In this case, the guide pins 24*b* and 26*b* are moved along the arcuate guide slits 112 and 114 of the bracket 110 respectively and their displacements in the guide slits 112 and 114 are compensated by the longitudinal openings 122 and 124 of the moving plate 120**.

When the moving plate 120 has been linearly moved backwards by a predetermined distance, the guide pins **24*b* and 26*b* of the tripod members 24 and 26 are not moved any more since they are stopped by the rear ends of the guide slits 112 and 114. The rotatable tripod members 24 and 25 are completely extend from the range housing 10, thereby achieving their extending positions shown in FIG. 1. At this state, the stopper 32 of the folding lever 30 is displaced in its rear position and does not disturb the downward levering of the gas supply lever 40 as shown at the phantom line of FIG. 5. When the gas supply lever 40 is levered downwards in this state, it forcibly pushes the rear end of the gas container 42 toward the gas supply cock 46 and brings the front gas outlet port of the container 42 into engagement with the gas supply cock thus to make it possible to ignite the burner 12**.

In addition, when the gas supply lever 40 is in downward levered position while continuing the gas supply for the burner 12, the folding lever 30 can not be moved frontwards, so that the movable tripod members 22, 24 and 25 can not be retracted in the range housing 10 when continuing the engagement of the gas container 42 with the gas supply cock 46 or when cooking, thus to achieve the desired safety of use of the gas range.

As described above, the portable gas range with the folding tripod in accordance with the present invention not only prevents the gas supply for the burner when the movable tripod members are not completely projected out of the range housing but also prevents disappearing of the movable tripod members into the range housing when the burner is supplied with gas, thus to achieve the desired safety of use of the gas range and to improve the using efficiency of the gas range. Furthermore, this gas range achieves projection and complete extension of the movable tripod members by simply pushing the push handle connected to the tripod folding lever, thus to facilitate the projecting and retracting operation of the folding tripod of the portable gas range. Another advantage of this gas range is resided in that the tripod members extend outward from the range housing under the burner and are bent inward in order to provide vessel support sections, thus to be prevented from being directly influenced by the burner flame, so that the tripod members are prevented from a thermal aging and increase the using life of the portable gas range.

Although the preferred embodiments of the present invention have been disclosed for illustrative purposes, those skilled in the art will appreciate that various modifications, additions and substitutions are possible, without departing from the scope of the invention as disclosed in the accompanying claims.

What is claimed is:

1. A portable gas range with a burner and folding tripod adapted to receive and burn gas from a gas container under the operation of an engaging lever comprising:

a housing having a bottom and an upper surface;

a bracket mounted on said bottom of said housing and rotatably supporting an opposed pair of rotatable tripod members each having a first section protruding from said housing to support the gas range and a second section disposed in said housing and having a distal end with its adjacent protrusion hinged to opposed sides of said bracket by hinge pins, said bracket having an opposed pair of arcuate guide slits respectively centering about said hinge pins;

a pair of guide pins fixedly mounted on said distal ends of said second sections of said rotatable tripod members and received in said arcuate guide slits respectively such that they are moved in said guide slits;

a moving plate placed on said bracket such that it is linearly moved forward and backward on said bracket, said moving plate mounting a rear tripod member on its rear end and provided with an opposed pair of longitudinal openings for movably receiving said guide pins penetrating said arcuate guide slits;

a tripod folding lever having a push handle at an end thereof protruding from said upper surface of said housing, the other end of said tripod folding lever being connected to said moving plate, thus to linearly move said moving plate when said push handle is pushed, said tripod folding lever having stopping means for restricting the operation of the engaging lever when said tripod folding lever is in its tripod folding position, thus to prevent gas supply to the burner of the gas range.

2. The portable gas range according to claim 1, wherein said stopping means of the tripod folding lever comprises a stopper extending forward from said tripod folding lever by a distance, said stopper being positioned under said gas container engaging lever and restricting the downward levering of said gas container engaging lever when said tripod folding lever is pushed forward in order to be placed in its tripod folding position.

* * * * *